United States Patent [19]

Jones

[11] Patent Number: 4,504,169

[45] Date of Patent: Mar. 12, 1985

[54] REFLECTIVE ROAD STUDS

[75] Inventor: Graham R. Jones, Lancashire, United Kingdom

[73] Assignee: Inoventors Limited, Blackpool, United Kingdom

[21] Appl. No.: 495,933

[22] Filed: May 18, 1983

[30] Foreign Application Priority Data

Nov. 3, 1981 [GB] United Kingdom ..... 8133158

[51] Int. Cl.[3] ..... E01F 9/06

[52] U.S. Cl. ..... 404/11; 404/14

[58] Field of Search ..... 404/11, 12, 13, 14, 404/15, 16; 52/98, 100; 403/2

[56] References Cited

U.S. PATENT DOCUMENTS

| | | | |
|---|---|---|---|
| 3,570,377 | 3/1971 | Gerber | 404/11 |
| 3,822,462 | 7/1974 | Chubb | 52/100 |
| 3,998,014 | 12/1976 | Bartels et al. | 52/100 |
| 4,049,358 | 9/1977 | King et al. | 404/11 |
| 4,130,370 | 12/1978 | Kone | 404/11 |
| 4,174,238 | 11/1979 | Fowles et al. | 403/2 |
| 4,413,923 | 11/1983 | Wright | 404/11 |

*Primary Examiner*—Stephen J. Novosad
*Assistant Examiner*—Bruce M. Kisliuk
*Attorney, Agent, or Firm*—Kenyon & Kenyon

[57] ABSTRACT

A reflective road stud comprises a resilient shell having a recess in which a reflective device is mounted. In order that an block insert having an array of reflective elements may be used, a flange is formed integrally with the shell behind the recess, and the block insert is bonded to the flange. In order to provide for a self-wiping action, slots are formed between the shell and the sides of the flange, and a shearable connection is provided between the shell and the bottom of the flange. Upon shearing or cutting of the connection, a wiper lip is formed which wipes the reflective elements, upon depression of the shell by a vehicle tire. In an alternative embodiment the block insert is mounted on a flap behind the recess.

7 Claims, 3 Drawing Figures

REFLECTIVE ROAD STUDS

FIELD OF THE INVENTION

This invention relates to reflective road studs and methods of forming such studs.

PRIOR ART

U.K. Patent Specification No. 457536 discloses a reflective road stud in which a block has side walls in which reflecting surfaces are embedded. The side walls have portions which project in front of and below the reflectors and are formed separately from the main body of the block by slits and the latter parts of the side walls are supported on lugs formed in a casting for receiving the block to be sunk into the road surface. When a vehicle wheel passes over the top of the block it presses the intermediate portions thereof wiping the reflectors against the supported portions of the side walls producing a cleaning action which is repeated when the block again rises. The forming of the slits complicates the manufacturing process of the block and has the disadvantage, as indicated in Specification No. 457536 that the slit may extend beyond the required length unless reinforcement is applied.

U.K. Patent Specification Nos. 615088 and 666859 show similar road reflector studs to those described in U.K. Patent Specification No. 457536 and the same disadvantages apply.

FIELD OF THE INVENTION

The invention provides a reflective road stud comprising a body having a resiliently flexible shell portion provided with an opening, and reflective elements mounted on the body and visible through the opening, the body further having a wiper portion adjacent the opening for wiping the reflective elements upon depression of the shell portion, and the reflective elements being carried on a flap portion of the body which depends from the shell portion across the opening to the wiper portion.

The invention also provides a method of forming a reflective road stud according to the first invention, the method including the steps of placing the reflective elements in a mould for the body, the mould being shaped such that the flap portion is moulded in a position extending outwardly from the shell portion, forming the body in the mould, removing the stud from the mould, and forcing the flap portion through the opening.

The invention further provides a reflective road stud comprising a body having a resiliently flexible shell portion and a flange depending downwardly from the shell portion in a recess in the shell portion, and outwardly visible reflective elements mounted on the flange, a gap being formed between the flange and each side of the recess to permit up and down movement of the flange in the recess, and the bottom of the flange being formed integrally with the bottom of the recess with a shearable connection so that when the connection is sheared, the bottom of the recess forms a wiper for the reflective elements upon up and down movement of the flange.

In a further aspect, the invention provides a method of forming a self-wiping reflective road stud, including the steps of providing a stud according to the third invention, and shearing the shearable connection to form the wiper for the reflective elements.

DESCRIPTION OF THE PREFERRED EMBODIMENTS

Figure 1:
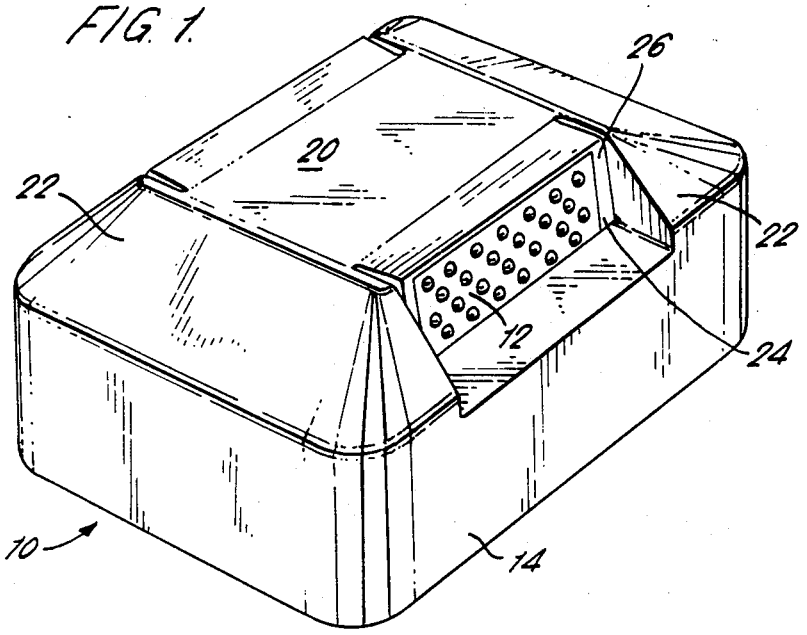
FIG. 1 is a perspective view of both embodiments of road studs.
Figure 2:
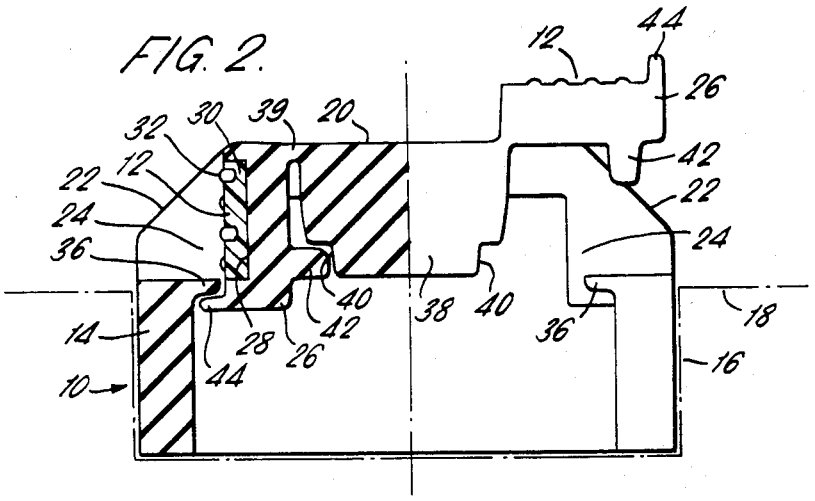
FIG. 2 is a side elevation of the road stud of the first embodiment, sectioned on a vertical longitudinal plane and with part of the reflector, on the right-hand side, shown in a position adopted during construction of the road stud.

Referring to FIGS. 1 and 2, a road stud for mounting on a road surface and reflecting vehicle headlight beams comprise a domed shell 10 which is moulded in rubber or a like resilient material and has a generally rectangular outline as viewed in plan, and a pair of reflective inserts 12.

The shell 10 is symmetrical about the center-line shown in FIG. 1 and has a generally rectangular skirt 14 which is of suitable size and shape for mounting into a standard holder, for 'cat's-eyes' and like road studs, the outline of the holder being shown by the line 16, so that the road stud is set into the road surface, depicted by the line 18.

Integral with the skirt 14, slanting sides 22 extend upwardly and inwardly to a generally flat top 20, the sides 22 and top 20 projecting, in use, above the road surface. The slanting sides 22 are arranged to bend and distort when the top 20 is run over by a vehicle, so that the top 20 is temporarily deflected downwardly to a position generally level with the road surface 18.

A pair of openings 24 are formed in an opposed pair of the slanting sides 22, and behind each opening 24, within the dome, a flap 26 depends from the top 20 and is integral therewith.

Each flap 26 is formed with a rectangular recess 28, into which is bonded one of the reflective inserts 12. Each reflective insert comprises an opaque substrate 30 carrying a regular array of semi-spherically headed translucent elements 32, which have a silvered or similarly treated backing so that the elements are reflective. The elements 32 may number twenty-six for each insert.

The arrays of reflective elements face generally along the road surface in opposite directions, and the reflective inserts 12 may be designed to reflect white light or only certain colours, as desired.

The lower edge of each rectangular opening 24 is formed with an elongate wiping lip 36 which projects towards the respective flap 26 and the lower edge of insert 12 carried thereby. The junction 38 between each flap 26 and the top 20 may be stressed by the resilience of the material to bias the flap 26 towards the lip 36, which lip is formed from the same resilient material. Also, the top 20 has a central thickened portion 38 provided with transverse rabbets 40 which engage transverse ribs 42 on the inner faces of the flaps 26 to hold the flaps and inserts 12 against the lips 36.

Thus, when the road stud is run over by a vehicle and the top 20 is displaced downwardly, the flaps 26 are also displaced downwardly causing each of the reflective elements 32 to be wiped by the resilient wiping lips 36 to remove any dirt from the elements 32. After the road stud has been run over, the top is returned to its initial position due to the resilient nature of the slanting sides 22, and thus the reflective elements 32 are wiped once more by the lips 36.

The engagement of the transverse ribs 42 on the flaps 26 with the rabbets 40 of the central thickened portion 38 of the top 20 enables the flaps 26 to be displaced downwardly without undue distortion of the junction 39 between the flaps 26 and the top 20.

Each flap 26 is provided with a ledge 44 which, when the reflector is undistorted, engages beneath the respective wiping lip 36 in order to prevent flap 26 springing out through the opening 24.

In constructing the road stud, the reflective inserts 12 are located in a mould tool, and the body 10 is moulded with the flaps 26 formed in the position in which the right-hand flap 26 is shown in outline in FIG. 1 so as to be integrally moulded around the reflective inserts 12. The flaps 26 are then folded downwards and forced through the openings 24 so that the ledges 44 engage under the wiper lips 36 and the ribs 42 engage the rabbets 40.

The road stud may be modified by reducing the distance, the flap 26 and the top 20 at each junction 39 so that the space below the junction 39 and between the flap 26 and central thickened portion 38 is wedge shaped.

Figure 3:
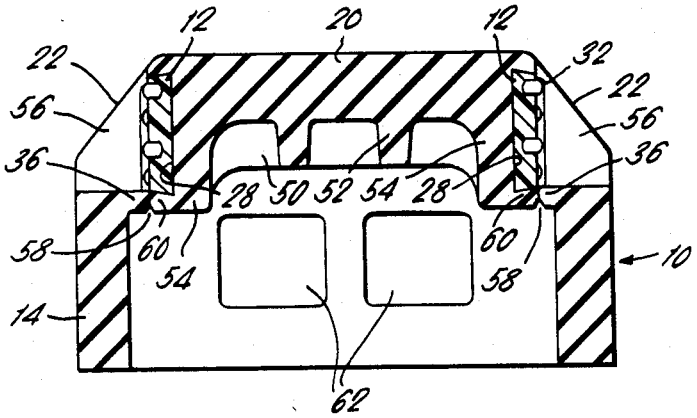
FIG. 3 is a side elevation of the road stud of the second embodiment, sectioned on a vertical longitudinal plane.

Reference is now made to the second embodiment illustrated in FIGS. 1 and 3. The second embodiment is similar in many respects to the first embodiment, and in both embodiments like features are designated by like reference numerals.

In the second embodiment, the top 20 is thinner than in the first embodiment and is provided with longitudinal ribs 50 and transverse ribs 52. The reflective inserts 12 are provided in flanges 54 which depend downwardly from the top 20 and are integrally formed with the wiper lips 36. Thus, each insert 12 is recessed in the shell 10. A vertical slot is formed between the flange 54 and the sides 56 of the recess, similar to the vertical slots on either side of the flaps in the first embodiment.

At the junction between each flange 54 and the wiper lip 36, a transverse groove 58 is formed during moulding of the shell 10. The groove is preferably V-shaped and may have a root angle of about 60°. These grooves 58 are provided to define shearable connections between the respective flanges 54 and wiper lips 36.

In order to complete the stud so that it is capable of wiping, a load can be applied to the top 20 so that the shell material adjacent the grooves 58 shears along the lines 60. The necessary load may be applied either by the manufacturer or the stud can be placed in a holder on the road and the necessary load will be applied when the stud is run over by a vehicle. Alternatively, the material may be cut along the lines 60 to form the wiping edges.

In both embodiments the moulded shell 10 may be lightened where possible by forming pockets and/or apertures, such as apertures 62 in FIG. 3, to reduce the amount of material required. Also, in addition to the ribs 50, 52 shown in FIG. 3, other strengthening ribs may be provided in either embodiment.

I claim:

1. A reflective road stud comprising a resiliently flexible downwardly open shell for mounting in a socket in a roadway, said shell having a top wall and a peripheral side wall encircling and depending from said top wall, said peripheral side wall having at least one portion which extends both downwardly from and outwardly of said top wall and at least one recess formed in said portion of the side wall, said recess having a wall extending generally vertically downwardly from said top wall of said shell on which one or more reflective elements are mounted and a ledge extending horizontally inwardly from said side wall towards the lower end of said vertical wall to rub against the reflective elements on said vertical wall when said top wall of said shell of the road stud is depressed by a passing vehicle, and means on the underside of said top wall of said shell to hold said vertical wall against deflection inwardly of said shell when said shell is depressed to ensure that the reflective elements on said vertical wall are wiped by the ledge.

2. A reflective road stud as claimed in claim 1 wherein said means on the underside of said top wall of said shell to hold said vertical wall against deflection inwardly of said shell when said shell in depressed to ensure that the reflective elements on said vertical wall are wiped by the ledge comprise abutment means extending downwardly from said top wall of said shell opposite the said side wall to bear against said side wall when said shell is depressed by a passing vehicle to hold the reflective elements on said side wall against the ledge of said shell.

3. A relative road stud as claimed in claim 2 wherein said side wall on which the reflective elements are mounted includes a rib portion extending inwardly from the inner side thereof towards said abutment means on the underside of said top wall of said shell to be engaged thereby when said shell is depressed by a passing vehicle to assist in holding said side wall in engagement with said ledge to ensure a wiping action by said ledge on the reflective elements.

4. A reflective road stud as claimed in claim 1 wherein said side wall includes an outwardly extending flange at the lower end thereof which engages under an edge of said ledge adjacent said side wall to limit return movement of said shell after depression by a passing vehicle.

5. A reflective road stud as claimed in claim 1 wherein said side wall of said shell includes a pair of recesses on opposite sides of said shell having vertically extending walls on which the reflective elements are mounted and to which ledges extend horizontally inwardly from said side wall towards the lower end of said vertical wall to rub against the reflective elements when said shell of the stud is depressed.

6. A reflective road stud as claimed in claim 1 wherein said means on the underside of said top wall of said shell to hold said vertical wall against deflection inwardly of said shell comprise rib means extending along the underside of said top wall to the vertically extending wall of said recess carrying the reflective elements.

7. A reflective road stud as claimed in claim 1 wherein said vertical wall and said ledge are initially formed integrally with one another with a shearable connection therebetween, said shearable connection being adapted to be sheared by the initial depression of the stud leaving the ledge free of said vertical wall to wipe over the reflective elements on said vertical wall when the stud is depressed.

* * * * *